US005361427A

United States Patent [19]

Wilk

[11] Patent Number: 5,361,427

[45] Date of Patent: Nov. 8, 1994

[54] PERSONAL BIDET AND ASSOCIATED METHOD

[76] Inventor: Peter J. Wilk, 185 W. End Ave., New York, N.Y. 10023

[21] Appl. No.: 181,666

[22] Filed: Jan. 14, 1994

[51] Int. Cl.[5] ..... A47K 3/22; A47K 7/08

[52] U.S. Cl. ..... 4/420.3; 4/443; 4/445

[58] Field of Search ..... 4/420.3, 420.4, 443, 4/444, 445, 446, 447, 599, 602, 603; 604/151

[56] References Cited

U.S. PATENT DOCUMENTS

| | | | |
|---|---|---|---|
| 3,377,629 | 4/1968 | DiPasquale | 4/445 |
| 3,416,529 | 12/1968 | Weisman | 4/443 |
| 3,577,567 | 5/1971 | Wintercorn | 4/445 |
| 4,140,120 | 2/1979 | Yamauchi | 4/443 |
| 4,324,008 | 4/1982 | Carr | 4/420.3 |
| 4,539,720 | 9/1985 | Westerweller | 4/602 |

FOREIGN PATENT DOCUMENTS

| | | | |
|---|---|---|---|
| 2425223 | 1/1980 | France | 4/602 |
| 478141 | 7/1928 | Germany | 4/443 |
| 329498 | 9/1929 | United Kingdom | 4/443 |

*Primary Examiner*—Henry J. Recla
*Assistant Examiner*—Charles R. Eloshway
*Attorney, Agent, or Firm*—R. Neil Sudol; Henry D. Coleman

[57] ABSTRACT

A bidet device comprises a substantially annular balloon member disposable on a toilet bowl rim or toilet seat. The balloon member is provided with an inlet port for enabling a filling of the balloon member with a fluidic cleaning agent such as water. A valve is operatively connected to the balloon for closing the inlet port upon a filling of the balloon member with the fluidic cleaning agent. An outlet port communicates with the balloon member and is connected thereto for dispensing the fluidic cleaning agent from the balloon member upon an application of compressive pressure to the balloon member, specifically by a person sitting on the balloon member.

16 Claims, 1 Drawing Sheet

PERSONAL BIDET AND ASSOCIATED METHOD

BACKGROUND OF THE INVENTION

This invention relates to a bidet device. This invention also relates to an associated method for enhancing personal hygiene.

A bidet is a device for personal hygiene which is widely used throughout Europe. A user sits on or squats over a bowl and rinses his or her private parts with a jet of water which is dispensed vertically upwardly or in an upward arc from an outlet in the bowl. Generally, the European bidet is a device separate from a toilet.

A toilet attachment for producing a jet of water in the manner of a bidet has been introduced. This toilet attachment is substantially permanent and includes a toilet seat provided with water outlets. The bidet toilet seat is therefore used by anyone sitting on the toilet.

In addition to generally enhancing personal hygiene, the use of a bidet is recommended for treating several afflictions, including hemorrhoids and cystitis.

OBJECTS OF THE INVENTION

An object of the present invention is to provide a bidet device for use with a conventional toilet bowl.

Another, more particular, object of the present invention is to provide a personal bidet device removably attachable to a toilet.

A further object of the present invention is to provide a method for personal hygiene which involves use of a bidet device.

These and other objects of the present invention will be apparent from the drawings and detailed descriptions herein.

SUMMARY OF THE INVENTION

A bidet device comprises, in accordance with the present invention, a substantially annular balloon member disposable on a toilet bowl rim or toilet seat. The balloon member is provided with an inlet port for enabling a filling of the balloon member with a fluidic cleaning agent such as water. A valve is operatively connected to the balloon for closing the inlet port upon a filling of the balloon member with the fluidic cleaning agent. An outlet port communicates with the balloon member and is connected thereto for dispensing the fluidic cleaning agent from the balloon member upon an application of compressive pressure to the balloon member, specifically by a person sitting on the balloon member.

According to a particular embodiment of the present invention, the device includes a floor member in the form of a web or plate connected to the balloon member along a lower side thereof so as to define with the balloon member a shallow cavity. In that case, the outlet port is connected to the balloon member via the floor member. The outlet port may be centrally disposed on the floor member. In addition, the floor member may be provided with one or more perforations for enabling a drainage of the fluidic cleaning agent from the cavity upon a dispensing of the cleaning agent into the cavity during use of the device.

Preferably, the floor member depends from the balloon member via a skirt so that the skirt and the floor member are insertable into a toilet bowl to fix the balloon member laterally with respect to the toilet bowl.

Where the outlet port is one of a plurality of outlet ports all communicating witch the balloon member and connected thereto, the balloon member is disposed substantially concentrically about the one outlet port, while another outlet port is disposed along a radially inner wall of the balloon member so that a stream of the fluidic cleaning agent from that other port has a radially inward vector component.

According to another feature of the present invention, the inlet port includes an elongate hose enabling a filling of the balloon member with water from a faucet at a sink.

A hygienic method in accordance with the present invention, utilizes a bidet device including a substantially annular balloon member having an inlet port, a valve operatively connected to the inlet port, and an outlet port. The method comprises the steps of (a) disposing the balloon member on a toilet bowl rim or toilet seat, (b) filling the balloon member with a fluidic cleaning agent via the inlet port, (c) closing the valve to temporarily retain the fluidic cleaning agent in the fluidic balloon member upon a filling of the balloon member with the fluidic cleaning agent, (d) pressurizing the balloon member by sitting on the balloon member upon a closure of the valve, and (e) dispensing the fluidic cleaning agent from the balloon member through the outlet port onto one's anus and/or external genitalia.

In one embodiment of the method, the balloon member is disposed on the toilet rim or seat prior to filling of the balloon member. Where the balloon member is provided with a hose for filling purposes, the hose is then extended to a faucet for guiding tap water therefrom.

The outlet port may be provided with a nozzle for spraying the fluidic cleaning agent.

According to a further feature of the present invention, the fluidic cleaning agent may be dispensed in a plurality of different directions.

A bidet device in accordance with the present invention is inexpensive and easy to use. The bidet is personal: it can be easily mounted to toilet temporarily for private use and subsequently removed and stored, so that the toilet is available for conventional use. Unlike more permanent fixtures, there is no need for complicated connections and valves. Pressure is applied automatically to eject water when the user sits on the device.

DETAILED DESCRIPTION

Figure 4:
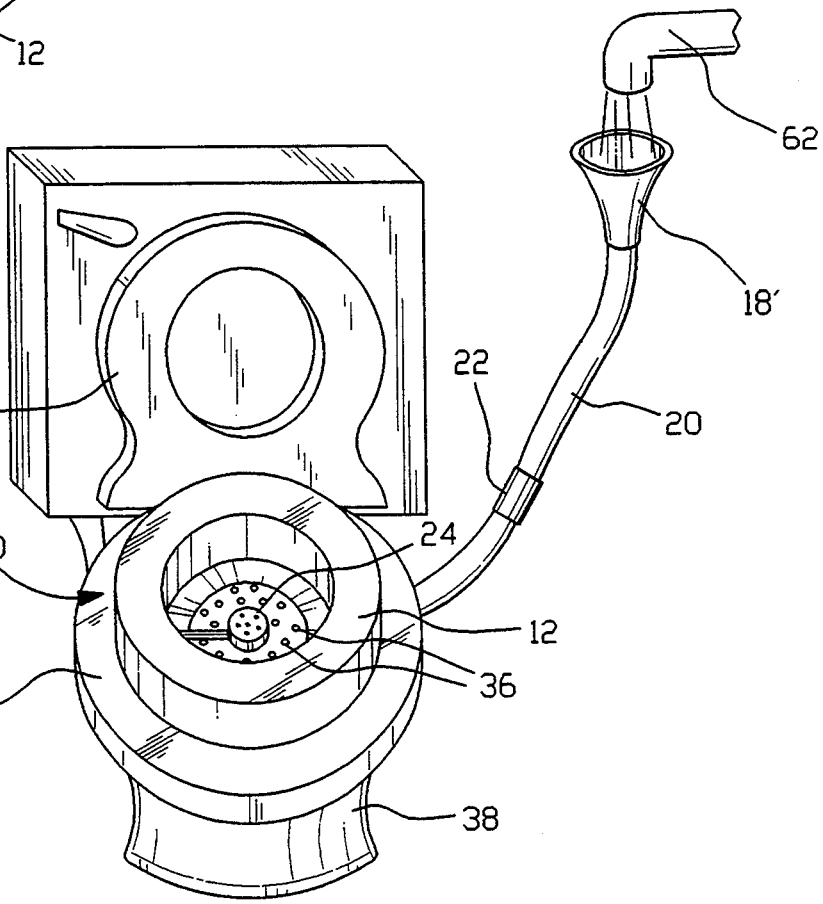
FIG. 4 is a perspective view of the personal bidet device of FIGS. 1–3, showing use of the device.

As illustrated in FIGS. 1–4, a bidet device 10 comprises a substantially annular balloon member 12 disposable on a toilet bowl rim 14 or toilet seat 16, as depicted in FIG. 4. Balloon 12 is provided with an inlet port 18 at the free end of a hose 20 for enabling a filling of balloon 12 with a fluidic cleaning agent such as water. A clamp or other valve element 22 is attached to hose 20 and thus operatively connected to balloon 12 for closing inlet port 18, i.e., for blocking communicating between the inlet port and balloon 12, upon a filling of balloon 12 with the fluidic cleaning agent. An outlet port 24 in the form of a spray nozzle communicates with balloon 12 via a connecting conduit 28 for dispensing the fluidic cleaning agent from balloon 12 when a user sits on balloon 12 and thereby applies compressive pressure to the balloon 12.

Bidet device 10 includes a floor member 30 in the form of a web or plate connected to balloon 12 via a skirt 32 along a lower side thereof so as to define with balloon 12 a shallow cavity or recess 34. Outlet port 24 is attached to floor member 30 generally centrally thereof.

Floor member 30 is optionally provided with one or more perforations 36 for enabling a drainage of the fluidic cleaning agent from cavity 34 upon a dispensing of the cleaning agent into the cavity during use of the device.

By virtue of skirt 32, floor member 30 is staggered with respect to balloon 12. Skirt 32 and floor member 30 are dimensioned so as to be insertable into a toilet bowl 38 while balloon 12 sits along rim 14 or seat 16. Balloon 12 is thereby fixed laterally with respect to toilet bowl 38 during use of the device 10.

Figure 1:
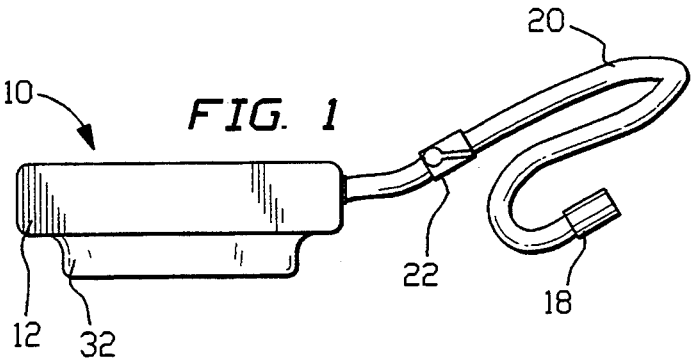
FIG. 1 is a side elevational view of a personal bidet device in accordance with the present invention.
Figure 2:
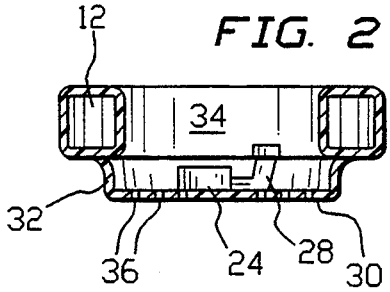
FIG. 2 is a cross-sectional view of the personal bidet device of FIG. 1.
Figure 3:
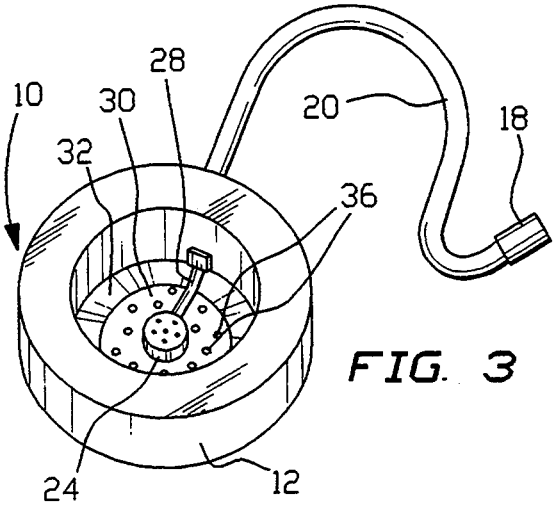
FIG. 3 is a perspective view of the personal bidet device of FIGS. 1 and 2.
Figure 5:
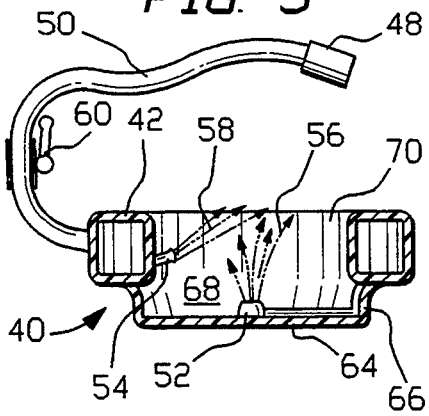
FIG. 5 is a cross-sectional view of a modified personal bidet device in accordance with the present invention.

As illustrated in FIG. 5, a personal bidet device 40 comprising an annular balloon member 42, provided with an inlet port 48 at the free end of a hose 50 for enabling a filling of balloon 42 with water, has a plurality of outlet ports or nozzles 52 and 54 for ejecting respective steams of water in at least partially upward directions, as indicated at 56 and 58. A clamp or other valve element 60 is attached to hose 50 for closing inlet port 48, i.e., for blocking communicating between the inlet port and balloon 42, upon a filling of balloon 42 with water from a faucet 62 (see FIG. 4). Outlet ports 52 and 54 dispense water from balloon 42 when a user sits on the balloon.

Bidet device 40 includes a floor member 64 in the form of a web or plate connected to balloon 42 via a skirt 66 along a lower side thereof so as to define with balloon 42 a cavity or recess 68. Outlet port 52 is attached to floor member 30 generally centrally thereof, while port 54 is attached along a radially inner wall 70 of balloon 42 so that the stream 58 of water from that port has a radially inward vector component, as well as an upward component.

In one method of utilizing bidet device 10 (or 40), balloon 12 is disposed on toilet bowl rim 14 or toilet seat 16 so that skirt 32 extends downwardly into the toilet bowl 38. Hose 20 is extended to a faucet 62 (FIG. 4) so that water fed to inlet port 18 or modified inlet port 18' flows to and fills balloon 12. Upon at least a partial filling of balloon 12, valve 22 is closed to temporarily retain the water in balloon 12. Subsequently, the user sits on balloon 12, thereby pressurizing the balloon and dispensing water from the balloon through outlet port 24 (or 52 and 54 in FIG. 5) onto one's anus and/or external genitalia.

It is to be noted that valve 22 or 60 may take different, equivalent forms. For example, those valves may be sliding plate valves, or clamps with lever actuated camming elements (see FIG. 5), a device for maintaining a kink in hose 20 or 50 upon formation of the kink by a user.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A bidet device for use with a toilet having a bowl with an annular bowl rim and a toilet seat comprising:

a substantially annular balloon member sized and adapted to extend over and along one of said rim and said seat, said balloon member being provided with an inlet port for enabling a filling of said balloon member with a fluidic cleaning agent;

a valve operatively connected to said balloon for closing said inlet port upon a filling of said balloon member with said fluidic cleaning agent; and at least one outlet port communicating with said balloon member and connected thereto for dispensing said fluidic cleaning agent from said balloon member upon an application of compressive pressure to said balloon member owing to a person sitting on said balloon member.

2. The device defined in claim 1, further comprising a floor member connected to said balloon member along one side thereof so as to define with said balloon member a shallow cavity.

3. The device defined in claim 2 wherein said at least one outlet port is connected to said balloon member via said floor member.

4. The device defined in claim 3 wherein said at least one outlet port is centrally disposed on said floor member.

5. The device defined in claim 2 wherein said floor member is provided with at least one perforation for enabling a drainage of said fluidic cleaning agent from said cavity upon a dispensing of said fluidic cleaning agent into said cavity during use of the device.

6. The device defined in claim 2 wherein said floor member is perforated with a multiplicity of drainage holes.

7. The device defined in claim 2 wherein said floor member depends from said balloon member via a skirt so that said skirt and said floor member are insertable into a toilet bowl to fix said balloon member laterally with respect to the toilet bowl.

8. The device defined in claim 1 wherein said at least one outlet port is oriented so that said fluidic cleaning agent is dispensed in a generally upward stream.

9. The device defined in claim 1 wherein said at least one outlet port comprises a plurality of outlet ports all fluidly communicating with said balloon member and connected thereto, said balloon member being disposed substantially concentrically about one of said outlet ports, another of said outlet ports being disposed along a radially inner wall of said balloon member so that a stream of said fluidic cleaning agent from said another of said outlet ports has a radially inward vector component.

10. The device defined in claim 1 wherein said inlet port includes an elongate hose enabling a filling of said balloon member with water from a sink faucet.

11. A hygienic method comprising the steps of:

providing a bidet device including a substantially annular balloon member having an inlet port, a valve operatively connected to said inlet port, and at least one outlet port;

disposing said balloon member on one of a toilet bowl rim and toilet seat;

filling said balloon member with a fluidic cleaning agent via said inlet port;

upon a filling of said balloon member with said fluidic cleaning agent, closing said valve to temporarily retain said fluidic cleaning agent in said fluidic balloon member;

upon a closure of said valve, pressurizing said balloon member by sitting on said balloon member; and dispensing said fluidic cleaning agent from said balloon member through said at least one outlet port onto a perineal region of the seated user.

12. The method defined in claim 11 wherein said step of disposing is implemented prior to said step of filling.

13. The method defined in claim 12 wherein said balloon member is provided with an elongate tube, said step of filling including the steps of connecting said tube to a faucet and running water through said tube to said balloon member, said fluidic cleaning agent being tap water.

14. The method defined in claim 11 wherein said at least one outlet port is provided with a nozzle, said step of dispensing including the step of spraying said fluidic cleaning agent from said nozzle.

15. The method defined in claim 11 wherein said at least one outlet port comprises a plurality of outlet ports fluidly communicating with and connected to said balloon member, said step of dispensing including the step of ejecting said fluidic cleaning agent from said outlet ports in a plurality of different directions.

16. The method defined in claim 11 wherein said balloon member is provided along one side with a floor member, said balloon member and said floor member defining a shallow cavity, said floor member having means for draining liquid therethrough, further comprising the step of draining said fluidic cleaning agent from said cavity upon commencement of said step of dispensing.

* * * * *